US005080525A

United States Patent [19]

Bricher et al.

[11] Patent Number: 5,080,525

[45] Date of Patent: Jan. 14, 1992

[54] FLOOR PAVING MACHINE AND METHOD

[75] Inventors: Charles W. Bricher; Alan R. Schuweiler, both of St. Paul, Minn.

[73] Assignee: Tennant Company, Minneapolis, Minn.

[21] Appl. No.: 163,028

[22] Filed: Mar. 2, 1988

Related U.S. Application Data

[63] Continuation-in-part of Ser. No. 944,530, Dec. 22, 1986, abandoned.

[51] Int. Cl.[5] ..... E01C 19/22; E01C 19/38; E04G 21/10

[52] U.S. Cl. ..... 404/96; 404/102; 198/671; 118/108; 425/62

[58] Field of Search ..... 404/96, 101, 102, 105, 404/114, 118; 198/671; 118/108, 207; 425/456; 411/348

[56] References Cited

U.S. PATENT DOCUMENTS

| | | | |
|---|---|---|---|
| 943,727 | 12/1909 | Ambers et al. | 404/83 X |
| 1,731,231 | 10/1929 | Chenoweth . | |
| 1,782,707 | 11/1930 | Bayley | 404/96 |
| 2,006,316 | 6/1935 | Mandt | 404/101 |
| 2,041,350 | 5/1936 | Johnson | 404/101 |
| 2,136,917 | 11/1938 | French | 404/102 X |
| 2,245,426 | 6/1941 | Baker | 404/102 |
| 2,289,168 | 7/1942 | Barber | 404/102 |
| 2,393,954 | 2/1946 | Baker | 404/105 |
| 2,430,816 | 11/1946 | Jackson | 404/114 |
| 2,888,864 | 6/1959 | Plas | 404/105 |
| 2,914,994 | 12/1959 | Pollitz | 404/118 X |
| 3,041,946 | 7/1962 | Watters | 404/101 |
| 3,091,999 | 6/1963 | MacDonald | 404/101 |
| 3,164,072 | 1/1965 | Blankenship et al. | 404/96 |
| 3,254,577 | 6/1966 | Guntert | 404/83 |
| 3,262,378 | 7/1966 | Schrimper et al. | 404/102 X |
| 3,273,474 | 9/1966 | Hardin | 404/101 |
| 3,305,887 | 2/1967 | Turner | 118/108 X |
| 3,375,765 | 4/1968 | Hanson | 404/101 |
| 3,403,609 | 10/1968 | Bradshaw et al. | 404/105 |
| 3,508,476 | 4/1970 | Smith | 404/102 |
| 3,785,001 | 1/1974 | Neimi et al. | 118/108 X |
| 3,797,953 | 3/1974 | Lindskob | 404/103 |
| 3,886,675 | 6/1975 | Maisonneuve | 198/671 X |
| 4,280,800 | 7/1981 | Bunn | 425/62 |
| 4,586,889 | 5/1986 | Krohne et al. | 404/96 X |
| 4,614,486 | 9/1986 | Bragagnins | 425/62 |
| 4,781,556 | 11/1988 | Paul | 425/456 X |
| 4,789,265 | 12/1988 | Wilson et al. | 404/75 |

FOREIGN PATENT DOCUMENTS

| | | | |
|---|---|---|---|
| 850777 | 7/1981 | U.S.S.R. | 404/102 |
| 1006561 | 3/1983 | U.S.S.R. | 404/101 |

OTHER PUBLICATIONS

Bulletin "Gomaco World", vol. 14, No. 2.
Bulletin "Pioneer Vibromatic", Model 12 Paver.
Bulletin, "Miller Spreader".
Bulletin "Barber Green", Model SB-41, Rubber Tired Finisher.

*Primary Examiner*—Ramon S. Britts
*Assistant Examiner*—Nancy Connolly
*Attorney, Agent, or Firm*—Kinzer, Plyer, Dorn, McEachran & Jambor

[57] ABSTRACT

This invention is a paving or resurfacing machine and method that places and trowels a layer of a trowelable coating material or overlay, such as a filled resinous material, on a surface to be coated, such as a concrete floor. The machine meters, distributes, strikes off and compacts a resurfacer material on a prepared surface resulting in a closed, smooth, dense, flat surface.

44 Claims, 8 Drawing Sheets

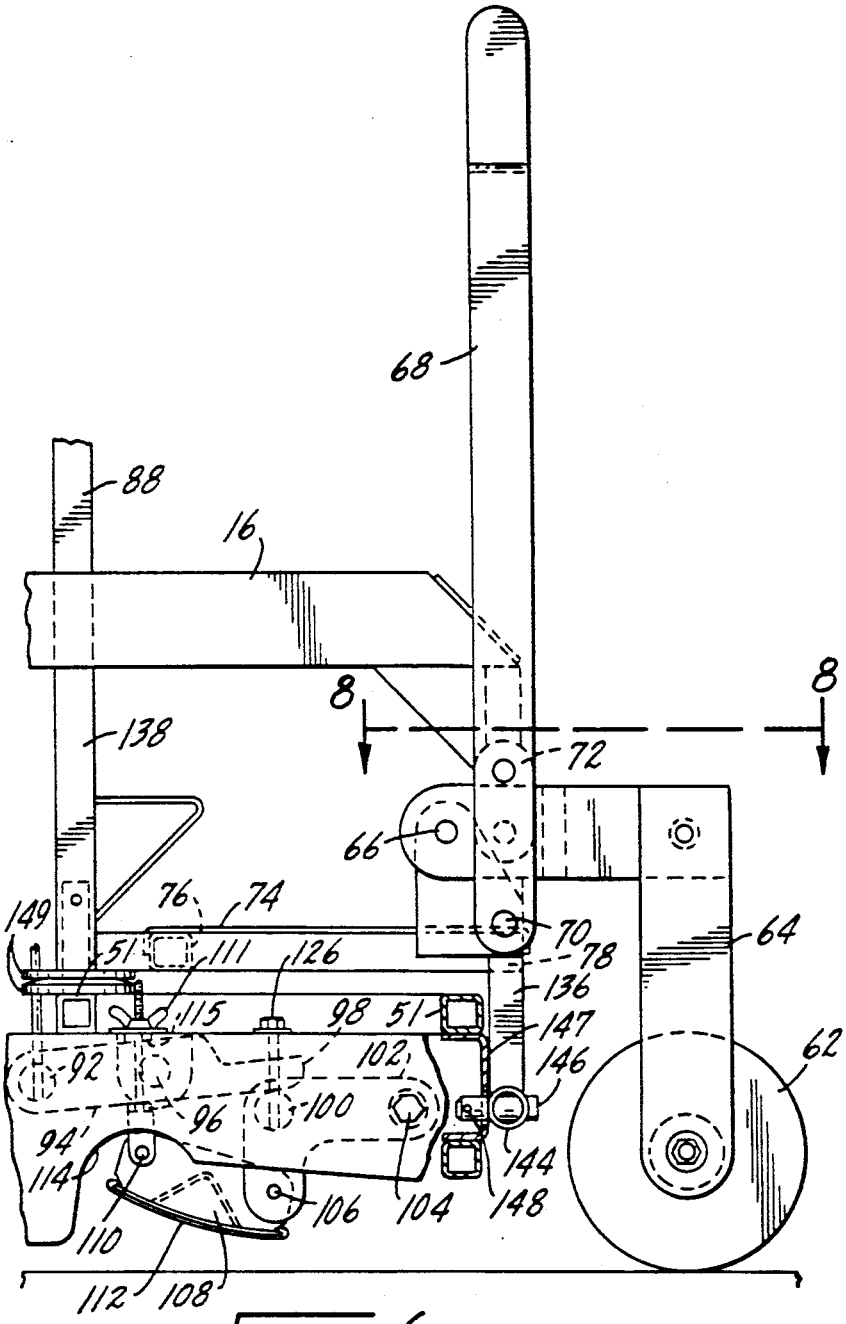
Fig. 6.
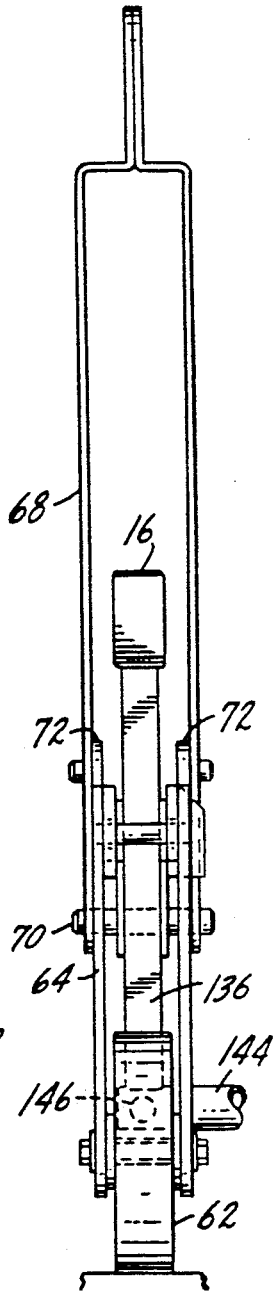
Fig. 7.
Fig. 8.
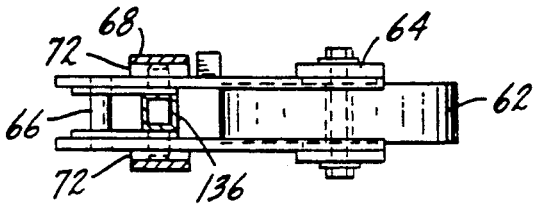

Fig. 14.
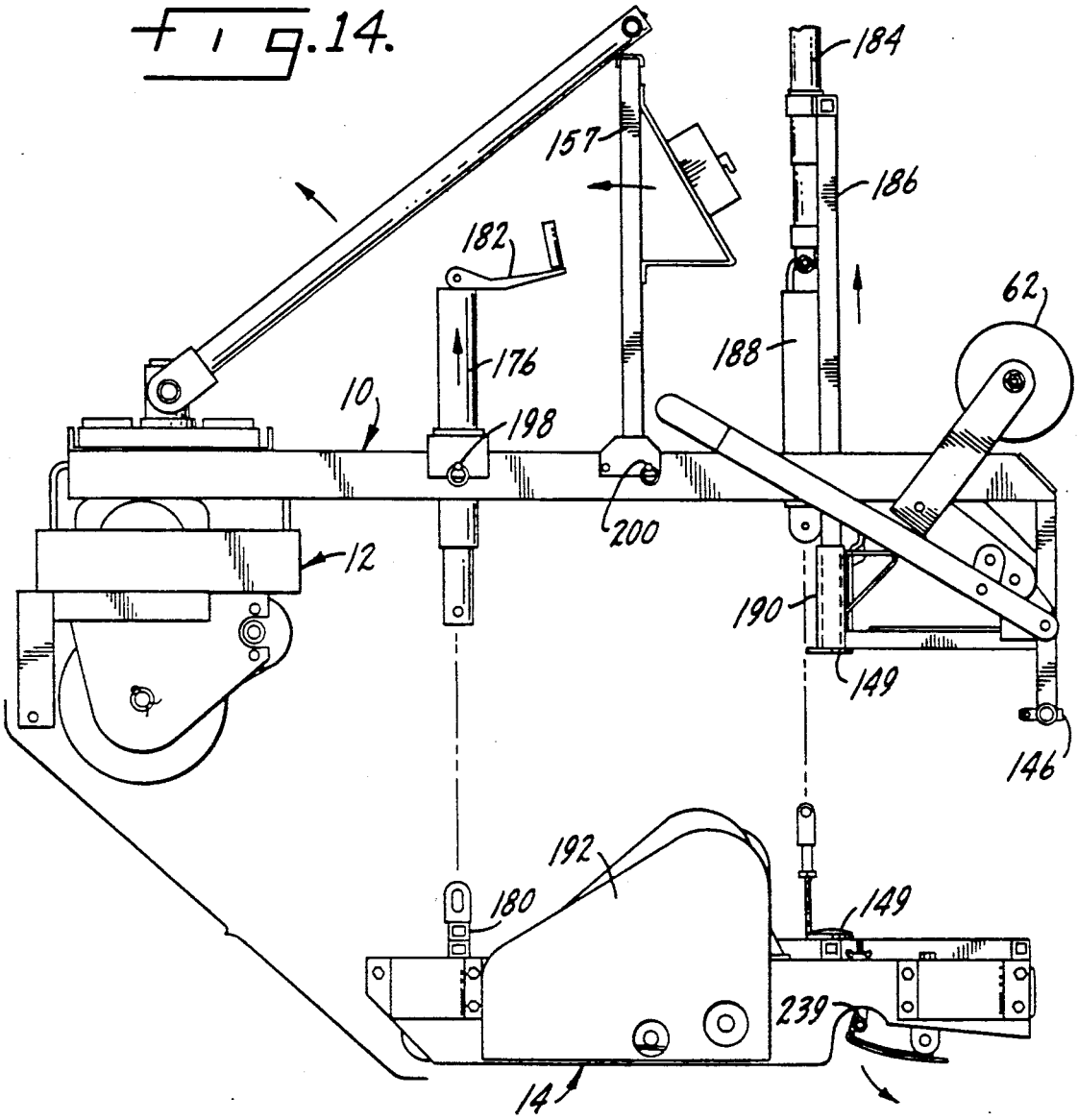
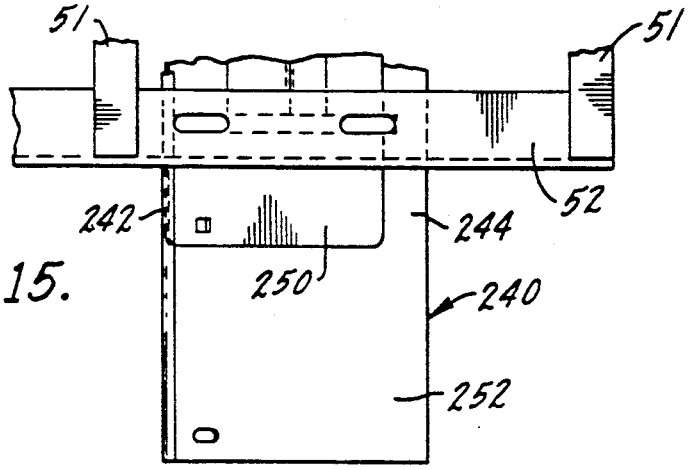
Fig. 15.

FLOOR PAVING MACHINE AND METHOD

This is a continuation-in-part of application Ser. No. 944,530 filed Dec. 22, 1986.

SUMMARY OF THE INVENTION

This invention is concerned with a machine and method for applying a trowelable coating to a floor or surface.

A primary object of the invention is a coating placement machine that simultaneously places and trowels a layer of trowelable coating material, for example a filled resinous material, to a surface to be coated, for example resurfacing a concrete floor or surface.

Another object is a machine and method of the above type in which the floor behind the machine will be desirably flat and there will be few if any undulations such as currently used power troweling produces.

Another object is a machine and method of the above type which will provide a substantially flatter surface than can be obtained by current practices and procedures.

Another object is a machine and method of the above type which will resurface a floor at lower cost than current procedures known as self leveling floor resurfacing.

Another object is a machine and method of the above type that may be electrically propelled and that meters, distributes, strikes off and compacts a resurfacer material, such as a filled resin, on a prepared surface resulting in a closed, smooth, dense, flat surface.

Another object is a machine and method that mechanically applies a resurfacer material and is substantially faster than hand methods.

Another object is a machine and method of the above type which is very efficient in distributing coating material over an uneven surface, providing compaction and improved surface appearance.

Another object is a machine and method of the above type that provides one pass operation without a rotating trowel.

Another object is a machine and method of the above type that places a coating of a trowelable material on a surface, ranging from $\frac{1}{8}$ to $\frac{1}{2}''$ thick.

Another object is a machine and method of the above type that closes up the surface and densifies the coating to eliminate or reduce a finishing operation.

Another object is a machine and method of the above type that reduces labor expenses.

Another object is a machine and method of the above type that has a high application rate.

Another object is a machine and method of the above type that provides a flatter and smoother surface than prior methods.

Another object is a machine and method of the above type that builds up worn floors.

Another object is a machine and method of the above type that meters, strikes off and compacts the coating on the surface to insure intimate contact of the coating and surface and to eliminate voids.

Another object is a method and apparatus for putting down a somewhat sticky, resilient material, such as a filled resin, in a thin layer, for example on the order of $\frac{1}{4}''$.

Another object is a machine of the above type which uses front and rear augers in which the rear auger has a substantially finer pitch and higher speed than the front auger so that it does not leave visible density variations in the thin coating material.

Another object is a shrouding mechanism for a high speed fine pitch rear auger in a machine of the above type which restricts the spray of thrown off excess coating material and directs it into and over the front auger for reuse and, at the same time, the lower edge of the scroll or baffle cooperates with the lower edge of the auger to screed the material on the surface.

Another object is a scroll and auger in a machine of the above type which has a minimum clearance between the scroll and auger where a portion of the scroll is concentric about the auger.

Another object is a machine of the above type which uses front and rear augers in which the rear auger has a pitch on the order of $\frac{1}{3}$ of the front auger and turns on the order of five times faster than the front auger so that the applied surface material is applied with uniform density.

Another object is a rear auger in a unit of the above type with an adjacent cleaner or scraper which removes much of the sticky resinous material from the outer edge of the rear auger.

Another object is a machine of the above type with a front screed which is less than full width and strikes off the material to a somewhat greater thickness than desired so that the spread material will hold together at that stage followed by a full width screed which works the material down to its final thickness, for example on the order of $\frac{1}{2}$ to $\frac{1}{8}''$ in a new and novel manner.

Another object is a rear full width screed for a machine of the above type which includes a concentric scroll and auger with minimum clearance between them, for example on the order of 1/16" with the two being adjustable up or down together and separately, with the rear bottom edge of the scroll and the bottom edge of the auger functioning as the final screed with the auger also functioning to keep the bottom edge of the scroll clean of material.

Another object is a machine of the above type that uses front and rear augers with the rear auger having a substantially finer pitch and rotating at a substantially higher speed than the front auger with the rear auger functioning in close cooperation with a shroud or scroll which substantially surrounds it for final depth control of the material.

Another object is a rear auger arrangement in a machine of the above type that cooperates to disintegrate the excess material into very small pieces and throws them forward in a spray and directs them into and over the front auger.

Another object is a machine of the above type for placing a filled resin floor resurfacing material having a high speed fine pitch rotating auger in a fixed shroud partially concentric about it which jointly serve to mechanically work the material so that it will be in a condition for screeding, and then screeding it into a smooth surface layer $\frac{1}{2}''$ thick or less, which is thinner than can be done with this material using only a common screed.

Another object is a machine and method of the above type that may be quickly and easily disassembled so that parts may be cleaned.

Another object is a trowel for a machine of the above type that applies uniform substantial pressure to the material being applied without bulldozing it ahead or pulling it up behind.

Another object is a trowel arrangement for a machine of the above type which presents a lower convex surface having a radius of curvature to compress the sticky filled resinous material without pulling it apart.

Another object is a trowel for a machine of the above type that has a facing with flexible ends to feather together adjacent strips of material.

Another object is a machine of the above type which has a spring loaded, front pivoted, convex bottom trowel with a down stop which permits an initial thickness of the coating material at the start of a run and the application of a precision resilient down force thereafter which may be accurately adjusted to control the final compacted density of the applied material.

Another object is a readily removable and cleanable trowel facing for a machine of the above type which prevents the coating material from building up on the trowel.

Another object is a machine of the above type with augers which are quickly removable for easy cleaning.

Another object is a trowel structure for a machine of the above type that has a curvilinear convex front portion and a trailing flexible edge that extends generally parallel to the surface being coated.

Another object is a trowel structure of the above type with a particular geometry that prevents bulldozing the material ahead and prevents the material from pulling up behind.

Another object is a trowel structure for a machine of the above type that is constructed and arranged to apply a gradual increase in compaction of the coating material being applied to the surface.

Another object is a machine of the above type that will work next to a wall.

Other objects will appear from time to time in the ensuing specification and drawings.

BRIEF DESCRIPTION OF THE DRAWINGS

FIG. 6 is a detail view on an enlarged scale of the transport unit;

FIG. 7 is an end view of a part of FIG. 6 with background details omitted for clarity;

FIG. 8 is a section taken along line 8—8 in FIG. 6.

FIG. 14 is like FIG. 13 with the two main components of the machine separated;

FIG. 15 is an enlarged top view of ore end of the trowel and trowel facing;

BRIEF DESCRIPTION OF THE PREFERRED EMBODIMENT

Figure 1:
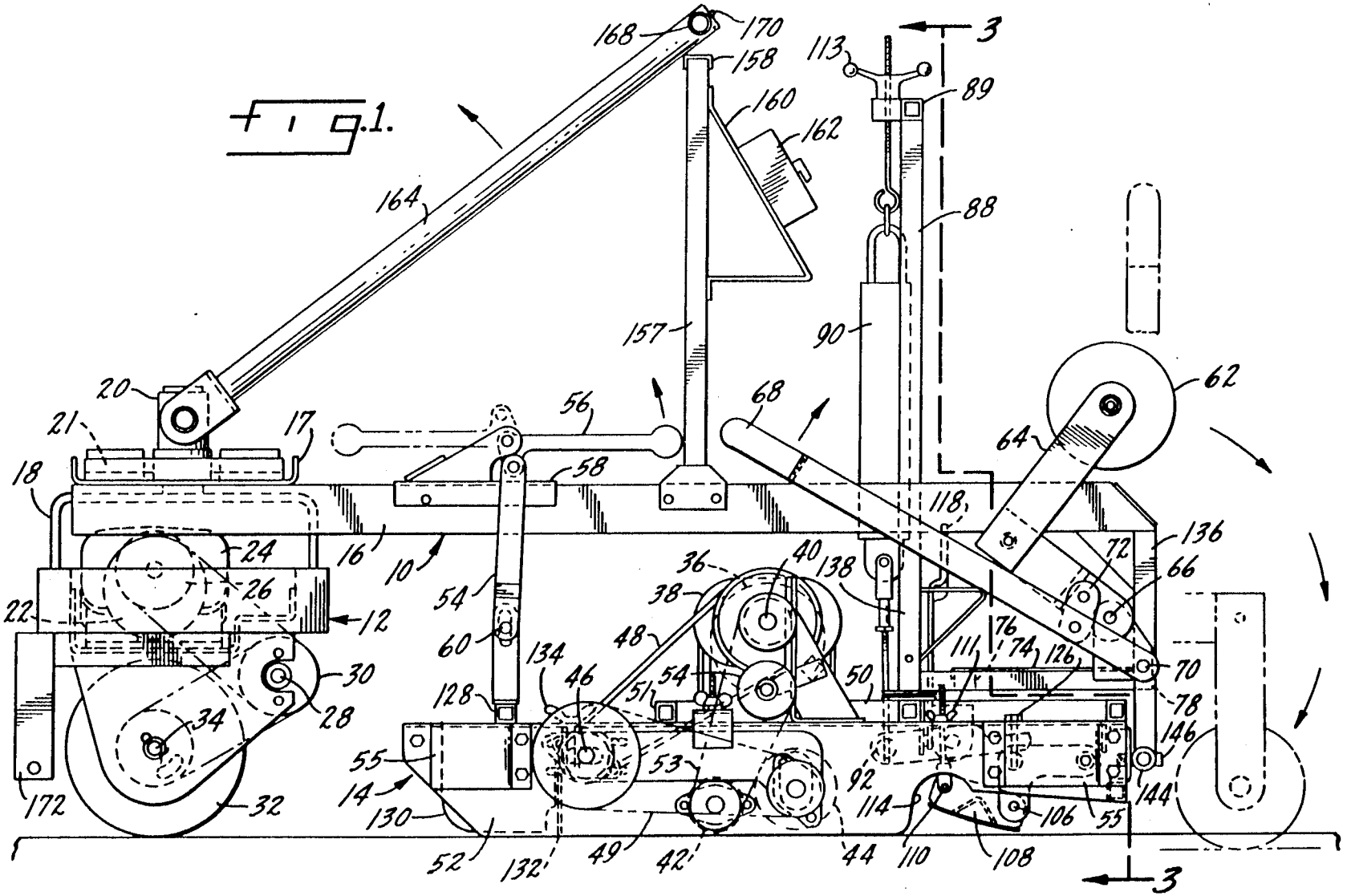
FIG. 1 is a side view of this machine with some positions shown in phantom.

In the drawings an elongated frame 10 has a tractor unit 12 at the front end and a sled 14 at or toward the rear end. The frame may include two elongated beams 16, one on each side, which are welded to a cross frame 17, which is connected to the top of the tractor unit through a U-shaped frame 18 and center pivot connection 20. This allows the tractor unit to rotate about a vertical axis for guidance purposes, i& being understood that the machine moves from right to left in FIG. 1. In addition, a longitudinal pivot 21 allows a certain amount of lateral rock of the tractor so that it can move across and accept an uneven surface without rocking the entire machine.

As shown, the tractor is electrically driven with a motor 22 driving a speed reducing gear box 24 which, through a sprocket and chain arrangement 26, drives a cross-shaft 28 which includes a differential and which, in turn, through sprockets and chains 30 on each side separately drives the wheels 32, it being understood that each wheel has its own axle 34 on each side, rather than a common axle, so that the center cf the tractor is open or generally so.

Figure 2:
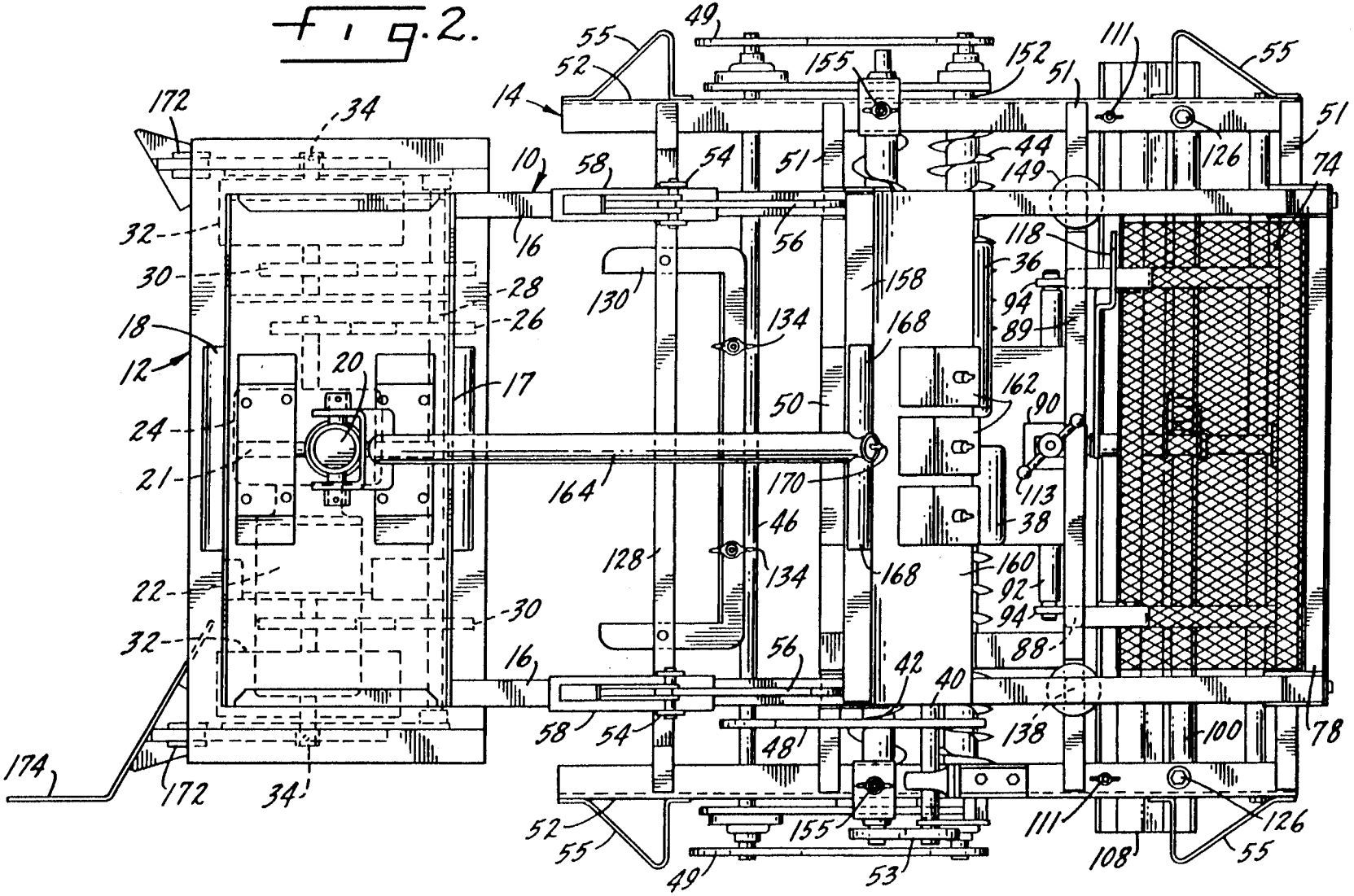
FIG. 2 is a top plan view of the machine of FIG. 1 with parts omitted for clarity.

The sled 14 is connected to and moved by the frame 16, which is moved by the tractor. It has an electric motor 36 with a speed reducing gear box 38 which is coupled &:o a shaft 40 which through suitable belts and chains drives two augers, a front auger 42 and a rear auger 44. The drive shaft 40 drives an intermediate or cross-shaft 46 through a chain 48 which in turn, through two outside belts 49, drives the rear auger 44. The drive shaft 40 drives the front auger through an outside belt 53 which may have a tensioning idler 54. Bumpers 55 may be used on the sides of the sled, as shown in FIGS. 1 and 2, if desired.

The result is that the drive speed from the motor and gear box is stepped up to the cross-shaft 46 and up again through the outside belts 49 so that the rear auger 44 runs at a higher speed while the belt drive from the drive shaft to the front auger 42 may be one to one. The result is that the rear auger runs substantially faster than the front auger.

The sled has a motor support platform 50 of any suitable type mounted between cross-rails or tubes 51 which connect to narrow runners or skids 52 on each side (FIG. 3) with the augers and shaft 46 disposed between and mounted on the skids.

The entire sled is adapted to be raised and lowered as follows. The front of the sled is connected to a linkage 54 which extends up and is connected to an over-center crank or arm 56 which is suitably mounted on frame member 16 at 58. There is one such crank and linkage on each side of the machine with two operative positions being shown in FIG. 1, the one in phantom being the raised position of the sled. In the lowered position where the skid engages the surface, any variation between the sled 14 and the frame 10 may be taken up by a lost motion connection 60 in the linkage. In the raised position, where the over-center crank is shown in phantom, the front ends of the skids for the sled will be raised up off of the surface.

The rear of the frame has a movable wheel on each side, as at 62, each of which is mounted on a crank arm 64 which is pivoted at 66 to the frame. A lever or handle 68 is pivoted to the frame at 70 and, through a link 72 moves the wheel from the top position which is inoperative to a bottom rear position where the distances are such that it raises the sled off of the floor by a certain amount, for example 1". The inoperative position of this mechanism is shown in full and the operative in phantom in FIG. 1. The operative position is also shown in FIG. 6.

Figure 3:
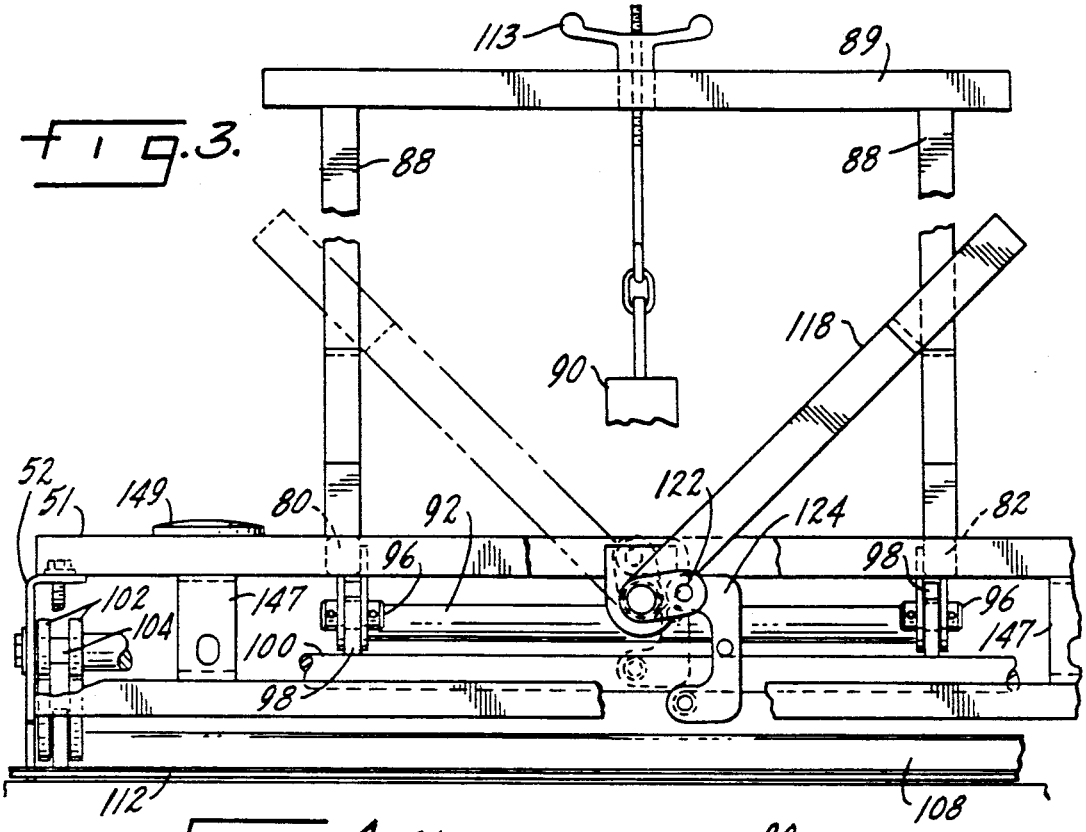
FIG. 3 is an end view on an enlarged scale of the sled unit of FIG. 1; with parts omitted, as viewed along line 3—3.
Figure 4:
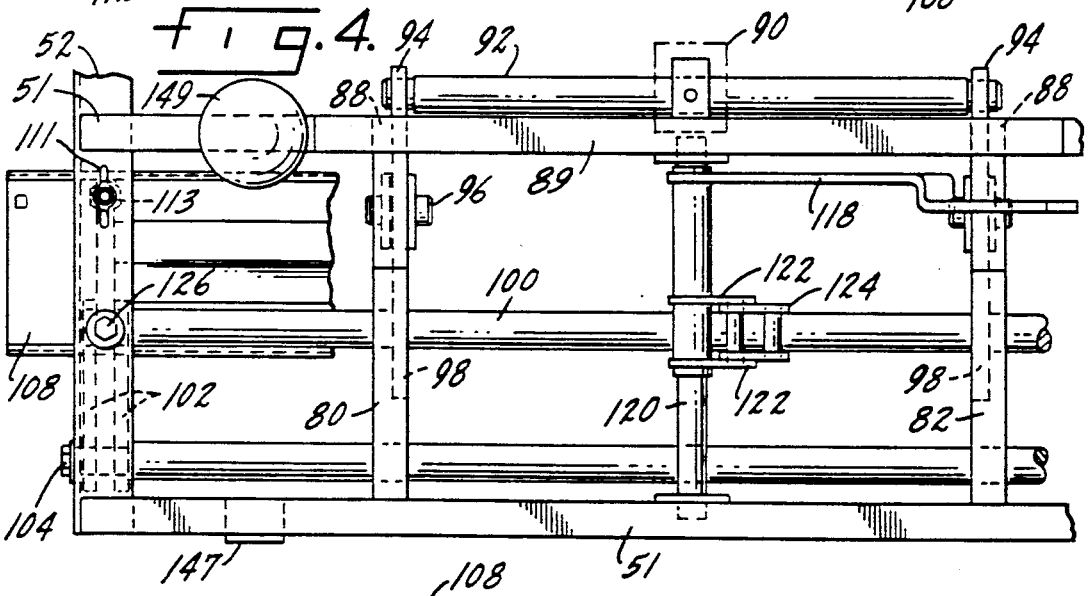
FIG. 4 is a top plan view of FIG. 3.

The frame has a rear operator platform 74 supported by two lateral tubes 76 and 78. The sled has longitudinal tubes or frame members 80 and 82, shown in FIG. 4, at its rear between cross rails 51, which are inboard somewhat of the skids, as shown in FIGS. 3 and 4. Two risers 88 and a cross member 89 together support the upper end of a spring scale 90 with the lower end of the spring scale being connected to a crossbar 92, in FIG. 1, which is connected on each end to rocker arms 94 which pivot at 96, as shown in FIG. 6. The rear ends 98 of the rocker arms bear on a cross-shaft 100 which is connected between bell cranks 102 on each side, one leg of each being pivoted to the sled at 104. The other end of each bell crank is pivoted at 106 to the rear of a trowel mechanism 108 which is pivoted to the sled at 110 and has a somewhat convex lower surface 112 which bears down on the coating material being applied to the floor. The forward pivot 110 of the trowel may be adjusted up or down by a bolt and wing nut 111. This adjustment may be locked in place by jam nut 115. The spring force from the scale 90 will tend to rotate rocker arm 94 clockwise in FIG. 1 which will bear down on shaft 100 and bell cranks 102 to lower the rear of the trowel by pushing down on pivot point 106 causing the trowel to tend to pivot clockwise a little. The spring scale's down force on the trowel may be changed and set at 113.

As noted in FIGS. 1 and 6, the skids of the sled have a rear cutout at 114 which extends rearwardly to clear the trowel which extends beyond the sides of the sled somewhat as shown in FIG. 2.

Figure 5:
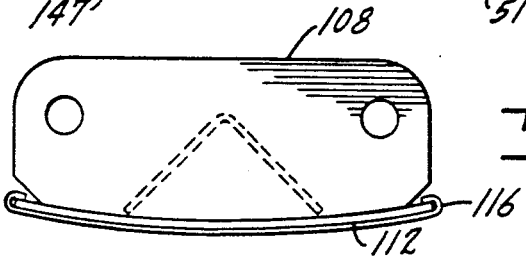
FIG. 5 is a detail view of one end of the trowel.

As shown in FIG. 5, the convex trowel has or accepts a quickly removable facing or cover 116 which is bent to fit around the trowel itself so that the facing actually bears down on the coating material and may be easily and quickly removed and cleaned or replaced from time to time if desired.

As shown in FIGS. 3 and 4, a lever arm 118 is pivoted by a sleeve on a longitudinal shaft 120 generally in the middle of the frame in front of the operator platform 74. The sleeve in turn carries one or more crank arms 122 which are pivoted to a C-shaped member 124 at the upper end thereof so that rotation of the lever 118 between the two positions shown in FIG. 3 will raise and lower the C-shaped member 124. It serves as a bracket around cross-shaft 100 which in turn is connected on each side to the bell cranks 102. The result is that when lever 118 is in the full position in FIG. 3 the C-shaped clamp or bracket 124 will be lowered which lowers cross-shaft 100 and allows the bell cranks to be operative to pass the down thrust of the spring scale to the rear of the trowel. When the lever arm 118 is in the phantom position shown in FIG. 3, the C-shaped bracket 124 will be raised which raises cross-shaft 100 which in turn rotates the rocker arms 94 counterclockwise somewhat, in FIG. 1, which overcomes and extends the spring scale 90 somewhat. The results is that any particular loading can be manually set on the spring scale 90 at 113. When the lever arm 118 is in the position in full in FIG. 3 this releases cross-shaft 100 and the spring pressure of the scale will be applied to the rear of the trowel. When lever 118 is moved to the other side, to the phantom position shown in FIG. 3, cross-shaft 100 will be raised sufficiently to overcome the spring scale. The result is that any particular pressure setting can be set on the scale and when the trowel is moved from its inoperative to its operative position by moving the lever 118, the down pressure will automatically be returned to what was previously selected for the spring scale. This is to say that the down pressure can be relieved and when it is returned, it will come back automatically to what was preset on the scale.

An adjustable bolt or stop 126 on each side on the skids extend down through and connect to the cross-shaft 100 to set the lower limit or maximum down position of the rear of the trowel 108. When the rear of the trowel is raised by the lever 118, the stop bolts 126 are free to rise slightly.

The front of the sled carries a cross-tube 128 which supports a screed box 130 in FIG. 2 which is open in front and has an adjustable panel or scraper 132 in the rear which may be raised and lowered by an adjustment mechanism which may include a wing screw 134 on each side. As noted in FIG. 2, the sides of the screed box are inboard of the skids somewhat.

The rear of the frame 16 has down members 136 on the rear thereof which terminate in a cross tube 144 with pins projecting forwardly therefrom as at 146 into vertically elongated openings, see FIG. 3, in a bracket 147 on each side of the sled frame. The pins 146 are secured through the holes in the brackets by cotter pins 148 or the like, see FIG. 6. The result is that the forward thrust of the tractor 12 on the frame 10 will push on the rear of the sled through push tube 144 and as well when the tractor backs up, the cotter keys will draw the sled rearwardly allowing some play at the joint. The weight of the frame 10 is applied to the sled through pads 149 between the top of the sled and the bottom of the frame. The upper pads are fastened to the lower ends of vertical frame members 138 of the frame. The lower pads are fixed to one of the cross tubes 51 of the sled. The lower pad should have a somewhat convex upper surface while the bottom of the upper pad may ba flat to allow for some misalignment.

Figure 9:
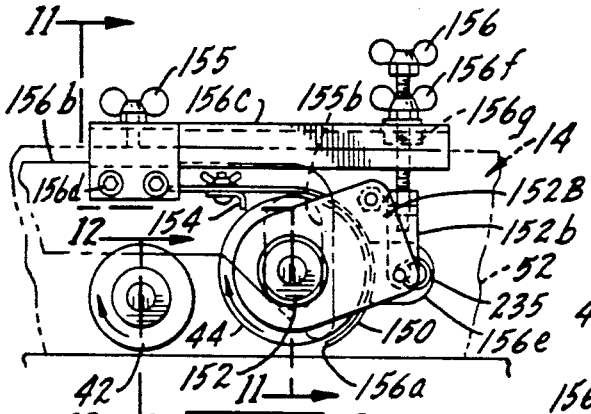
FIG. 9 is a partial side elevation of an auger shield and scraper assembly with a part of the sled shown in phantom.
Figure 11:
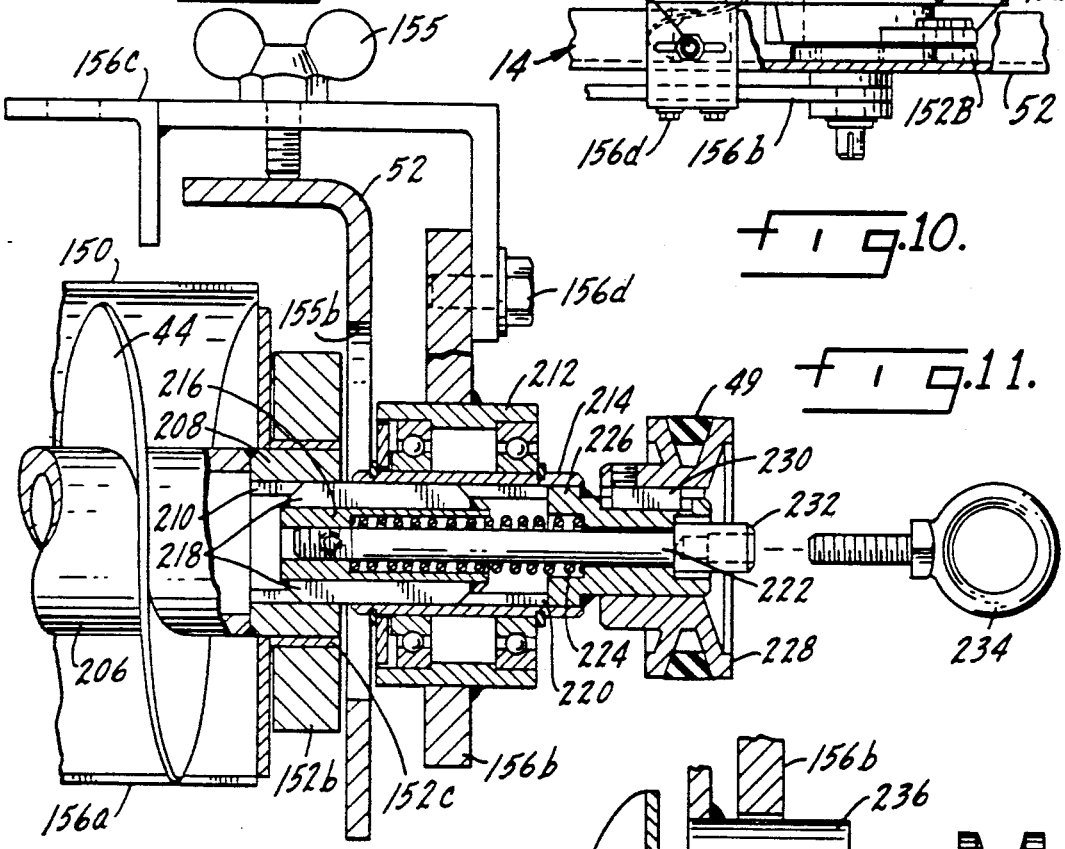
FIG. 11 is a section along line 11—11 of FIG. 9 on an enlarged scale.

In FIG. 2 it will be noticed that each of the augers has right and left hand sections which come together generally in the middle. The direction of rotation of the forward or spreading auger 42 in FIG. 1 is clockwise which will spread the material from the center to the outside. The direction of the strike off auger 44 is also clockwise in FIG. 1 which will strike off the excess material and bring it toward the center. A shield or shroud 150 shown in FIG. 9 is positioned over and around the strike off auger and may extend the full lateral width thereof on the machine and is mounted at each end on the shaft 152 of the auger by an adapter **152*a* which may be welded or otherwise suitably connected along its inner edge to the scroll or shield 150. The adapter 152*a* may be bolted or otherwise suitably secured to a support 152B which extends inwardly around the shaft of the auger 152 as shown in FIG. 9. Support 152B has bushing 152C as shown in FIG. 11 so the support may remain stationary while the auger rotates. Adjustment of the scroll 150 around the auger 44 takes place by manipulation of thumbscrew 156 which is connected by clevis 152*b* and quick release pin 235 to an ear 156*e* which is welded or otherwise suitably connected along its inner edge to the scroll. The thumbscrew extends through a lift bracket 156*c*, and the adjustment is locked by pinching the lift bracket between a wing nut 156***f* and a nut 156*g* which may be secured to the shank of the thumbscrew with a set screw.

Manipulation of thumbscrew 155 which extends through the lift bracket 156*c* and engages the top of the sled 52 adjusts the strike off auger 44 up or down in vertical slots 155*b* in the sides of the sled 52 which automatically raise: the scroll up or down as the strike off auger is adjusted up or down. Lift brackets 156*c* are mounted on arms 156*b* by bolts 156*d* or the like.

The excess material from the strike off auger will tend to be projected forwardly by the shield or scroll into the path of the auger and used again. The shield carries a laterally disposed scraper 154 which may be adjusted to contact the outer edge of the auger to prevent the build up of coating material. The height of the strike off auger 44 may be adjusted relative to the surface as at 155, and the scroll or shroud 150 may be adjusted radially relative to the auger 44 as at 156. The latter adjustment will give a small and precise adjustment of the height of the scroll's lower edge relative to the lowest point or bottom of the auger.

Figure 10:
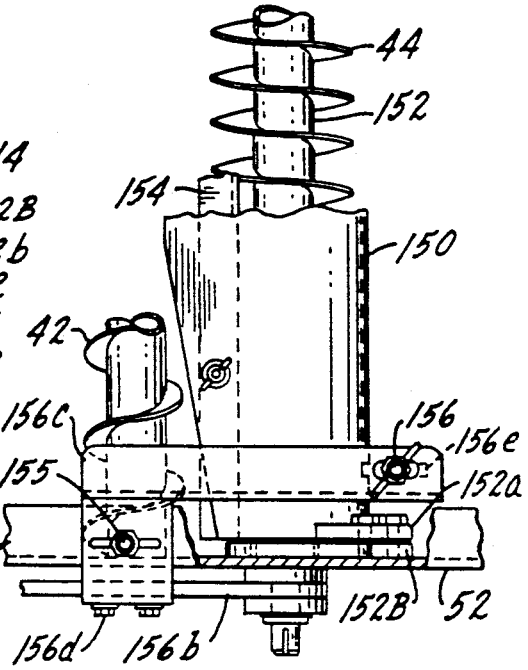
FIG. 10 is a top plan view of FIG. 9.

The lower edge 156*a* of the scroll or shroud 150 acts as a full width screed and scrapes the material down to its final precise thickness before the trowel compacts it. The scroll edge 156*a* may start to push material forward and build up on its lip, but the auger shaves this off and removes it, so that the scroll edge, which functions as a screed, stays clean and effective. This requires that the clearance between the scroll and auger be kept to a minimum and is held as close as manufacturing tolerances permit. The scroll 150 and auger 44 are mounted on arms 156*b*, shown in FIGS. 9 and 10, one on each side, which are freely pivoted on the cross-shaft 46 as shown in FIGS. 1 and 2. The dead weight of the auger, scroll, lift brackets, etc. are all raised up and down by turning thumbscrews 155 which pivots the entire auger structure about the cross shaft 46 on arms 156*b*. Also, the auger, scroll, etc. will rise in response to bumps and the like in the surface being coated which will protect the auger against damage. The position of the scroll edge 156*a* may be adjusted about the center line of the auger 44 by the two wing bolts 156, one near each end of the scroll, to give the precise control of its height that is needed when working with a thin layer of material.

As shown in FIGS. 1 and 2, risers 157 on each side of the frame with a cross piece 158 at the top support an inclined control panel 160 which may have suitable controls 162 thereon which are easily accessible from the platform 74 where the operator may stand, facing to the left in FIG. 1, during operation of the machine.

A drawbar or control handle 164 may le pivoted transversely on the vertical pivot 20 of the tractor so that it may be disposed in a rearward position as shown in FIG. 1 or it may be rotated forwardly to a more or less straight out position to the left in FIG. 1. It will be understood that the end of the drawbar has handlebars 168. When the drawbar is disposed forwardly, the operator may walk in front of the machine and turn the tractor either left o right by swinging the drawbar to one side or the other. The controls 170 in the drawbar will allow the operator to control the machine when he is walking in front of it instead of standing on the rear platform. The front of the tractor has a bracket 172 in FIGS. 1 and 2 on each side on which is mounted a removably mounted plow 174, shown in FIG. 2, as explained hereinafter.

A variant form is shown in FIGS. 11 through 17 which is similar in many respects to the previous species, so only the important differences will be explained.

Instead of the over-center cranks or arms 56 in FIG. 1 which are used to raise and lower the front of the sled, a screw jack 176 is mounted on a cross piece or brace 178 with the jack being positioned in the center and connected to a cross piece 180 mounted across the front of the sled. Thus operation of the jack handle 182 will rotate a lead screw within the jack which will either raise or lower the front of the sled.

Figure 13:
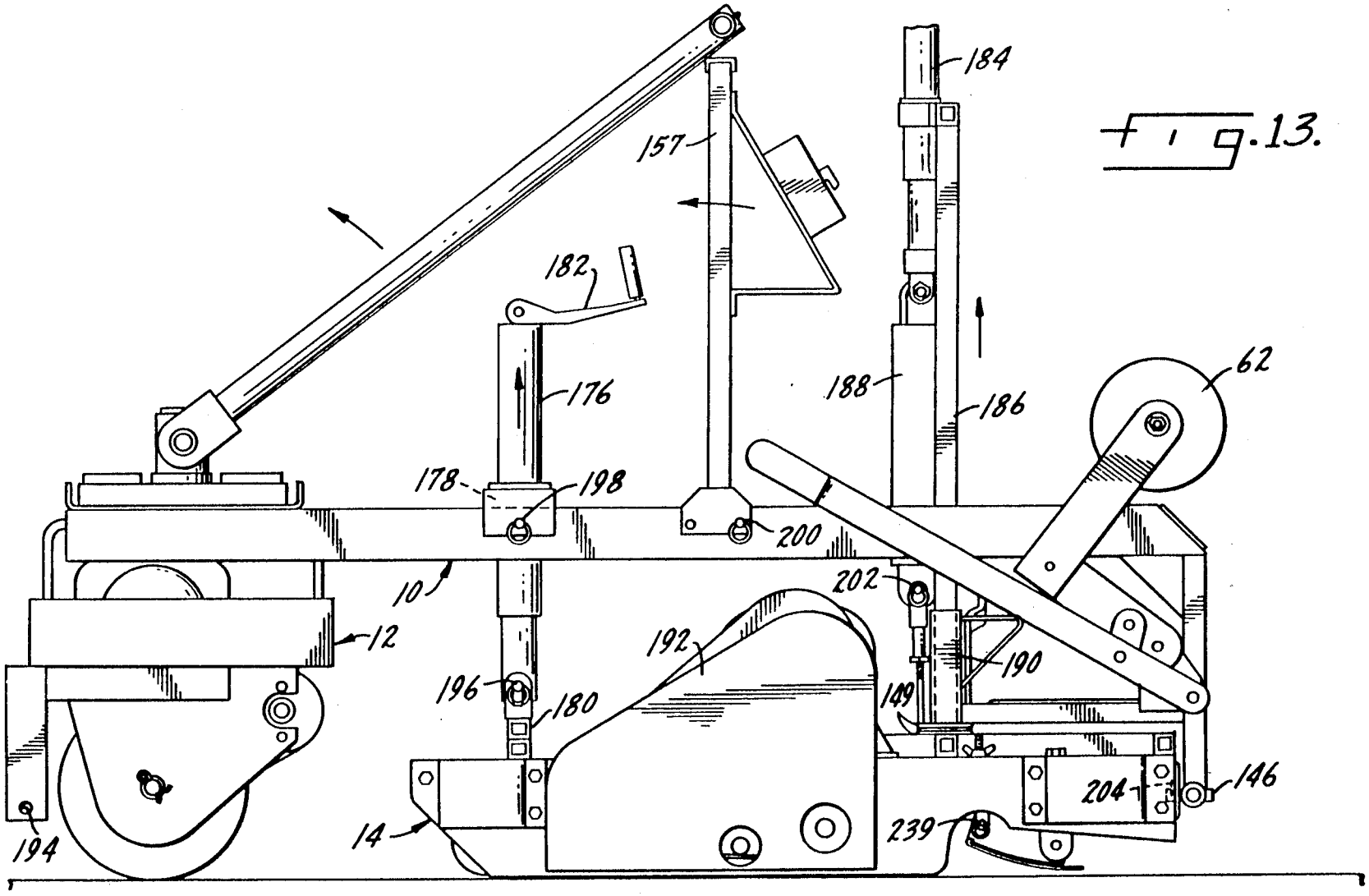
FIG. 13 is a side view of a modified form.

A similar handle operated screw jack 184 may be mounted in the center of the upright frame 186 which is similar to the risers 88, cross member 89 and hand screw 113 in FIG. 1 to tension the spring scale 188, which may be the same as spring scale 90 in FIG. 1. The lower ends of the risers 186 are shown mounted in sleeve type sockets 190 so that the uprights 186, screw jack, etc. may be separated from the frame for traveling. The bottom of the sockets or sleeves 190 are connected to the upper pad of the fulcrum, as at 149 in FIG. 2. The FIG. 13 form is shown with a belt cover 192 whereas FIG. 1 has the belt drive fully exposed. But a cover could be used in FIG. 1. In FIGS. 13 and 14 some of the reference numerals that were applied to the major components in the FIG. 1 species have been repeated for purposes of explanation, for example the frame has been designated 10, the tractor 12, the sled 14, etc.

A number of the connections between various parts in the machine are made by what are referred to as quick connect-disconnect attachments such as a hairpin cotter of the general type shown on page 7 of the catalogue "Industrial and Agricultural Fasteners & Fittings", January 1984 by Pivot Point, Inc. of Hustisford, Wis. or quick release pins of the type shown on page 10 of the same catalogue and referred to as "detent ring pins".

A plow, such as shown at 174 in FIG. 2, is mounted on the front bracket by a quick release pin as at 194 in FIG. 13. Another quick release pin 196 connects the lower end of the screw jack 176 to the sled bracket in front. The cross brace or support 178 for the jack 176 is also connected to the frame 10 by a quick release pin 198 on each side so that jack 176 can be easily removed for traveling. The risers, designated 157 in FIG. 1 for the control panel, are also connected at one point by a quick release pin 200 on each side of the frame so that upon release of the pins, the control panel can be pivoted about its forward connection, as shown by the arrow in FIG. 13 until it lies flat on the frame for more compact stowage in a truck during traveling from job to job.

The lower end of the spring scale 18( is connected by a quick release pin 202 to the linkage leading to the trowel. The pins in the rear of the frame that connect into the back of the sled, designated 146 in FIG. 1, may have a hairpin cotter or the like through cross holes on the inside, as at 204 so that they can be quickly released.

The result is that only four quick disconnects need to be disconnected, one at 196 between the front cf the sled and jack 176, the second at 202 between the bottom of the spring scale and the linkage running to the trowel and two at 204 between the rear of the sled and the rear push bar on the frame to completely disconnect the frame from the sled, as shown in FIG. 14. With the rear wheels, such as at 62 in FIG. 1, rotated to the down position such as shown in FIG. 6 the tractor and frame can be backed off a little to move the rear pins out of the rear of the sled at the quick disconnect 204 and then the frame may be rolled away from the sled. The sled may then be tipped up on one end to expose its underside so its side runners, etc. can be cleaned and the augers can be removed for cleaning and replacement as explained hereinafter.

FIG. 11 shows the right end of the rear high speed auger 44 and shroud 150, and it should be understood that the other end may be the same. The rear high speed or strike off auger 44 has a center core or tube 206 with a socket 208 welded in the end thereof having two axially disposed key slots or grooves 210. Release arm 156*b* has a center hub 212 which, through suitable bearings as shown, rotatably supports a tube 214 which slidably supports a plunger 216 which has raised keys 218 on each side thereof which match and are received by the key slots 210 in the hub and also slide in slots 220 in tube 214. A rod 222 is screwed into or otherwise connected to the plunger 216 and is biased to the left by a spring 224 which bears against an adapter 226 welded in the tube. A pulley 228 for drive belt 49 is mounted and fixed on the adapter as at 230. The end of the rod 222 may have a threaded socket 232 which removably receives an eyebolt 234. The scroll 150 may be disconnected from the wing bolt 156 by a quick connect-disconnect pin 235 as shown in FIG. 9.

The result is that when the eyebolt 234 is screwed into the threaded socket 232 and is pulled to the right in FIG. 11, the rod will be withdrawn somewhat bringing the plug 216 with it and withdrawing the plug from the socket 208 in the end of the auger. This disconnects the lift arms 156*b* from the auger 44 and shroud 150 and with the quick connect-disconnect pin 235 released the auger and shroud can be removed for cleaning and/or replacement. It will be understood that the opposite end of auger 44 and shroud 150 may be supported by a structure the same as or similar to what is in FIG. 11 such that the auger and shroud will be released at both ends.

Figure 12:
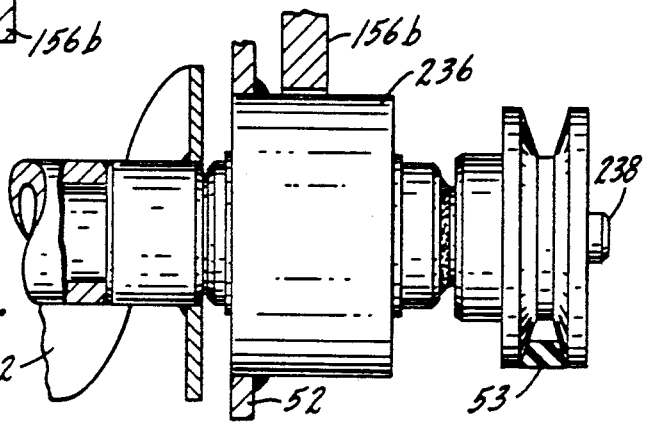
FIG. 12 is a section taken generally along line 12—12 of FIG. 9, also on an enlarged scale.

FIG. 12 shows the mounting for the spreading auger 42. Its mounting sleeve 236 which is welded or otherwise suitably secured in the sled runner 52 may be the same on the inside as the quick release mechanism in FIG. 11. An eyebolt such as at 234 in FIG. 11 may also be inserted in the end of a rod such as at 238 in FIG. 12 at each end of the auger. A plunger, not shown, but similar to 216 is withdrawn and the auger 42 may be removed for cleaning and/or replacement. Replacement of each of the augers requires that the key slots such as at 210 in FIG. 11 be lined up with the keys or ribs 218 on the plunger which is simple to accomplish. Thus the two augers may be removed for cleaning when the sled is turned up on end or in raised transport position. Cleaning may take place for example by dipping the augers in a trough of solvent and spraying them with a water hose to remove the accumulated coating material, after which they can be replaced in the machine. The front connection for the trowel may also be provided with two quick release pins as at 239 in FIG. 13. When the sled has been tipped up, the trowel may be pivoted down about its rear connection so that the top surface of the trowel may be cleaned. While the quick disconnects for the ends of the augers have been explained in connection with FIGS. 11 and 12, it will be noted that it is applicable to the FIG. 1 form.

Figure 16:
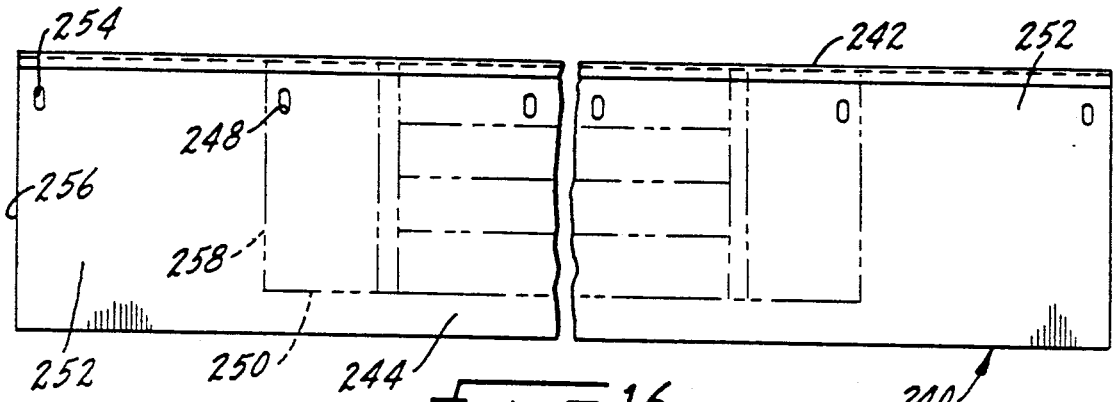
FIG. 16 is a top view the trowel cover or facing with various positions shown.
Figure 17:
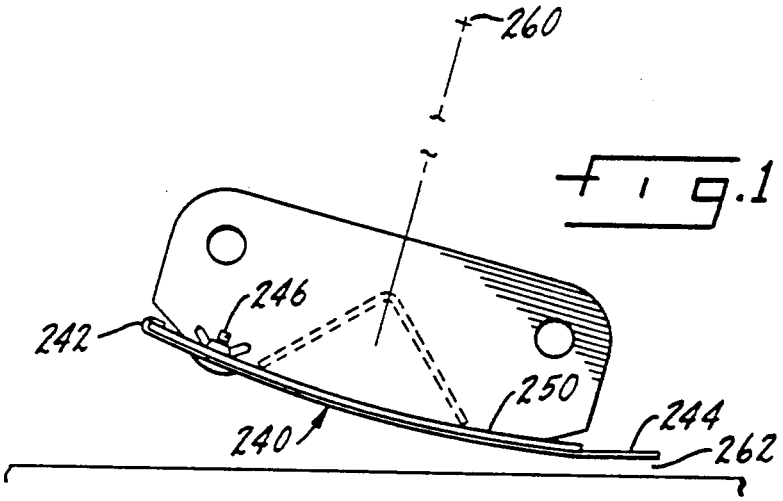
FIG. 17 is a side view, on an enlarged scale, of the trowel and trowel cover of the FIG. 13, 14 modification.

The trowel cover or facing in the FIG. 13 form has been modified as shown in FIGS. 15 through 17. The facing 240 is reversely bent around the front edge of the trowel as at 242 and extends freely a short distance beyond the rear edge of the trowel as at 244. The facing is held in place on the trowel by suitable wing nuts and bolts 246 which extend through slots 248 in the cover or facing so that the heads of the bolts are exposed on the under side. But since this is at a level well above the point where the trowel cover engages the coating material, it does not create a problem. A facing is shown from the top in FIG. 16 with the trowel 250 superimposed in phantom lines thereon, and it will be noted that the facing extends freely beyond either end of the trowel as at 252. The facing may be provided with three spaced holes or slots 254 on each end. As shown in FIG. 16 the facing is in its neutral position or centered on the trowel so that an equal amount of the facing as at 252 extends beyond each end. Since the facing is much more flexible than the trowel, the overhang will smoothly feather together adjacent coating strips as explained in connection with the FIG. 1 form. When it is desired that the machine work next to an upright structure, such as a wall, the wing nuts and bolts 246 may be released and the facing moved to one side or the other so that the edge, for example the left edge 256 of the facing, coincides or lines up with left edge 258 of the trowel. The overhang of the facing on the other side will then be twice as much. The point is that the facing may be shifted either left or right so as to coincide with either one edge of the trowel or the other so that close work next to a wall may be accomplished.

The geometry of the trowel and facing is important. As shown in FIG. 17 the lower surface of the trowel and facing are convex and are swung on an arc about a center indicated diagrammatically at 260. It has been found that the convexity of the trowel and its facing should be neither too abrupt or too slight which will cause the material to push up ahead or pull apart behind or both. In particular, if the radius is too sharp, the material will be bulldozed ahead.

Compression effected by the trowel is important. The degree to which compression takes place and progresses and the degree to which the trowel facing releases the material is important in providing a thin, dense layer while preventing the coating from being pulled apart behind the trowel. The compression of the material by the trowel is both a densifying and affixing process and the degree of compression may be on the order of 50% of the loose material height. In addition, the radius of curvature brings the lower surface of the facing to a point adjacent the surface being covered where it may be said to be tangent to a plane parallel to the surface and above it at the distance corresponding to the thickness of the coating. Thereafter, trailing edge 244 of the facing follows and may be assumed to be generally parallel to the surface so that the coating is at its final thickness as indicated at 262 in FIG. 17. The downward spring force applied to the rear of the trowel is relieved somewhat from the facing once it extends beyond the rear edge of the trowel due to the natural flexibility of the facing, and the force applied then to the material will be caused by the trailing portion 244 which will be under load somewhat due to its flexibility or stiffness. The trailing edge 244 of the facing may be assumed to be generally parallel to the surface which is to say it may be flexed up somewhat from its free state. The result is that the trailing edge 244 finishes the smoothing and compacting and presents a clean smooth surface on the finished coating and, at the same time, insures that it will not be torn or curl up behind the trowel. This in combination with the somewhat large radius of curvature of the trowel and facing, on the order of something like 16"-20", insures smooth, gradual compaction without bulldozing. First, this compresses the coating fully and brings it uniformly to its final thickness, second, it sets it at the proper thickness on the surface, third, it fully fixes or adheres the coating to the surface to an extent that, fourth, the coating does not pull up or tear loose behind the trowel. Furthermore, the surface left by the trowel is exceedingly flat; much flatter than can be achieved by hand troweling.

It has also been found useful in practice to use an initial screed box ahead of the tractor unit 12, something like the unit shown at 130 in FIG. 1. But it has not been illustrated or described in connection with either species since it is not presently considered important and, under certain circumstances, may be dispensed with.

Also, while the rear supporting wheels 62 for transport have been shown connected to the rear of the frame, they could be connected to the rear of the sled. And in one form or another it might be desirable to make these caster wheels instead of regular wheels so that the entire machine may be pushed sideways.

We have found on occasion that it is desirable to spring mount the lower side edges of the screed box 130, but that is an optional feature depending upon the surface and the material being applied. The same would be true of a front screed box if one were used.

The use, operation and function of the invention are as follows.

The object of the machine and method is to resurface a worn or rough concrete floor by applying a coating of trowelable material, for example a sticky filled resinous material, in the range of ⅛ to ½" thick and leave a smoother, flatter surface than is possible by hand screeding and troweling. The coating may be a filled epoxy, urethane, acrylic or the like, but at the moment a filled epoxy is preferred. The worn floor will have been suitably prepared before the resurfacing operation.

Many aspects of the machine and method are self-explanatory from the previous detailed description. The machine is mobile with a traction unit in front, referred to herein as a tractor, which is pivoted to the frame for steering. A sled behind the tractor in the order of travel has first a screed box followed by two augers, the second being partially shrouded by a scroll shaped cover, and a trowel. The coating material, be it a filled epoxy or other filled resin, is first dumped on the floor in a batch, possibly by windrowing. The tractor wheels are far enough apart so that they straddle the batch of material. The screed box then encounters the mass and levels or spreads it somewhat by the rear gate or baffle which is adjustable so that the loose material can be brought to a suitable thickness which will flow under the gate without tearing, but still be confined generally within the sides of the box. At this point the material is thicker and narrower than desired. The material then is contacted by the spreading auger 42, which rotates clockwise in FIG. 1 to spread the material from the inside out to the full auger width and bring it to a selected thickness, for example on the order of one half to three fourths inch or thereabout.

Next, the strike off auger contacts the material and reduces it to the thickness needed by the trowel. The strike off auger also rotates clockwise in FIG. 1 so that the bottom side of the auger is moving forward. It operates at a substantially higher speed than the spreader auger, for example, on the order of 5 to 1.

The pitch of the strike off auger is substantially finer than that of the spreader auger, and it cooperates with the scroll which partially surrounds it to insure that the material will be at the desired height when it reaches the trowel.

The trowel may be preset at the front so that its convex lower surface starts above the material. The object of the trowel is to apply a firm down force to compact and smooth the material and adhere it to the surface. The spring scale may be set to apply the optimum yieldable down force to the rear of the trowel which will depend on the condition of the material being used. The final thickness of the material is controlled by the amount of material that is fed through the screed box and the augers. Adjustment bolts determine the maximum down position of the rear edge of the trowel and set it slightly off the floor so that material can start to flow under it at the beginning of a strip. After a short distance, however, the material will force the trowel up and it will ride on the material under the spring load of the scale.

For either transportation or while not operating, the throw out lever can be moved to overcome the scale spring load and raise the rear of the trowel. When a new strip is to be laid, the throw out lever can be moved to release the scale and allow the previous spring load to be reapplied to the rear of the trowel. The unit is easily moved from one location to another by raising the front of the sled and lowering the rear wheels.

The operator may stand on the platform on the rear of the frame and his weight will be added to that on the sled. He may direct the machine from that position with the electrical controls and guide it by the drawbar when it is in its FIG. 1 position, or he can station himself on foot in front of the machine, and operate the machine from there. The runners on each side of the sled bridge over dips and indentations in the floor and provide a true reference for the new surface.

Substantial down pressure on the trowel is desirable to adhere the coating to the floor, eliminate the internal voids in the coating and close up the surface. The machine weight will be carried by the tractor and the sled runners, except that some weight will be transferred from the sled runners and carried by the trowel, depending on the setting of the spring scale. This scale allows the load which is applied to the trowel to be very accurately determined and set for whatever material is being applied.

The connection between the frame and the tractor and also between the frame and the sled is such that both the tractor and sled are allowed substantial freedom of motion without influencing the frame. This is to say that the tractor can tilt somewhat about a longitudinal axis due to one of its wheels being in a depression without affecting the frame. Or, as shown in FIG. 1, if the tractor, for example, starts uphill, the front end of the frame will rise which will cause the rear push bar 144 to drop down which is accommodated by the elongated openings in the brackets 147, as shown in FIG. 3, on the rear of the sled. Also a lost motion connection 60 in the front toggle arrangement of FIG. 1 or at 196 in the connection of screw jack 176 in FIG. 13 will allow the front of the frame to rise without raising the front of the sled. A pivoting action takes place about the pads 149. Thus the sled will not be affected. The same would be true if the tractor started down an incline.

The plow 174 is normally used on either side or the other so a mounting on the front of the tractor is provided on each side. After a first strip of material has been laid, the plow is positioned on the side next to that strip before the machine lays a second strip. The plow is lined up longitudinally with the narrow skid of the sled on that side. On laying the first strip, some of the material or coating will spread out beyond the sled through opening 114 in the sled runner. It will be noted in FIG. 2 that the trowel extends beyond the skids of the sled on each side and as the material is compressed and set by the trowel, it will move laterally a few inches outside of the skids. It will be noted that the skids of the sleds are cut back or removed around and behind the trowel so that the material is free to move out. In laying the next strip, the skid of the machine next to the previously laid strip is lined up and moved as nearly as possible in the path of the previous skid on that side. The plow will pick up the excess material that is spread on that side from the first strip, move it inwardly and recycle it through the machine. At the same time, the plow will form a more or less right angle shoulder along the first laid strip which will hold its dimensional stability sufficiently until the second strip is laid and abuts it. The trowel on that side of the machine will overhang the joint or abutting faces of the two strips and will smoothly feather the two together so that a perceptible or objectionable line of demarcation will not show.

In practice it is also desirable to have the facing 112 on the trowel extend beyond the ends of the trowel itself. For example, the trowel 108 might extend, say, an inch or two beyond the sides or runners of the sled while the facing might extend, say, six inches. The result will be that the extended or overhung facing will be quite flexible and will smoothly feather together adjoining coating strips. The plow is used when the machine is doing adjacent passes so that it removes and recycles the excess material along the edge of the previous strip next to the new material.

One of the problems in applying a thin layer, for example on the order of ¼", is that the layer will be too thin to hold together. The screed box 130 is less than full width. Its scraper 132 is set high enough to pass a material mat thick enough to hold together, for example at least three fourths inch, which is two or three times the desired final thickness. With the material initially set at that thickness, the final screed which is the final or rear auger together with its scroll precisely scrapes the loose material down to its final thickness before the trowel compacts it. Initially the front auger 42 spreads the material to about the desired final width. The rear auger 44 and its scroll 150 cooperate to shave off the excess material and leave a thin layer. The scroll edge 156*a* may start to push material forward and to build up a layer of material on its lip, but the auger 44, operating in close proximity to the scroll, immediately shaves this off so that the scroll edge remains clean and effective, thus performing the final screed function. The clearance between the scroll 150 and the auger 44 is kept to a minimum, and is held as close as manufacturing tolerances permit for example on the order of 1/16".

The height of the scroll edge 156*a* relative to the bottom of the auger should be finely adjustable to give the precise control needed for working with various specific materials. This is accomplished by mounting the scroll concentric with the auger and adjusting it circumferentially around the auger with thumbscrews 156. Both the auger and the scroll are on arms 156*b*, one on each side of the machine, which are pivoted on the cross-shaft 46 and adjustable up and down by two wing bolts 155, one on each side of the machine.

In addition, the rear auger has a much finer pitch than the front auger, for example 3 to 1 and turns much faster, for example about 5 to 1. If the rear auger has the same pitch and speed as the front auger, the rear auger will leave a visible herringbone appearance in the finished surface due to density variations in the material. Such marks are much finer and will blend together and can not be seen, or perhaps do not occur at all when the rear auger pitch is small and its speed is high. A fine pitch and high speed for the rear auger are important features in laying a thin layer of a resinous material. Its close cooperation with the shroud for final depth control of the material is also an important feature.

Additionally the rear auger turns fast enough to throw the excess material forward. In doing this, the auger breaks up or disintegrates the excess material into very small pieces which tend to spray in all radial directions. The top of the scroll extends forward to restrict the spray and directs it into and over the front auger. In this process, the sticky material is uniformly distributed across the machine so that it is in a compressible condition to be readily compacted by the trowel.

The scraper 154, which works against the outer edge of the rear auger at the top of the scroll, functions to clean the auger. Otherwise, the sticky nature of the resinous material would cause it to build up on the auger, which would cause an interference between the auger and the closely fitted portion of the scroll.

The quick connect-disconnect attachments explained in connection with the FIG. 13 species have the advantage that the augers may be quickly removed for cleaning by separating the frame from the sled, and tipping the sled up. The coating material, which is a sticky resinous material, has a tendency to stick to the flights of the augers and they require frequent cleaning. By having the quick connect-disconnect attachments, the augers may be removed, immersed in a tray cf solvent for cleaning, and replaced. Or a spare set of augers may be used for the next run. This may be required as often as once every two to four hours.

The quick removability of the trowel facing also allows it to be removed and put in a pan of solvent while a second or substitute is used. Again the coating material will tend to adhere to the facing and roughen its surface. To prevent scratches from forming in the coating behind the trowel it is necessary to change and clean the facing from time to time. This may be required as often as once every twenty minutes or after each pass with the paver.

It will also be noted that when the strike off auger is removed, its shroud or baffle comes with it so that both may be cleaned as a unit. This is important because the coating material will tend to build up on the shroud as well. For a more thorough cleaning it can be separated from the auger by removing one of the arms that attach it to the auger tube.

The quick disconnect for the control panel frame as at 200 in FIG. 13, has the advantage that when it is removed, the control panel may be pivoted forward about the front connection so that it lies flat on the frame when the unit is being stowed in a truck. The same is true of the quick disconnects 196 and 198 for the front jack and 202 for the spring scale support frame, which allow them to be completely removed.

The flexible overhang of the trowel facing on a joint between two adjacent strips is extremely important in the feathering action described so that there will not be a discernible line of demarcation between adjacent strips. This is accomplished by the end of the flexible facing extending beyond the trowel which greatly improves the interface by a feathering action.

The action of the trowel itself as shown in FIG. 17 when formed in a large radius, for example 16 inches, has the advantage of no bulldozing ahead of the trowel and no build up or tear out of material behind the trowel. The trailing edge of the facing completes a smooth, gradual compacting action and fixes the coating at its final thickness, for example ¼", to the surface being coated. The facing may be thought of as swung on a constant arc although it could be a gradually decreasing radius in the nature of a spiral with a minimum radius at the forward edge and the maximum or infinite radius at the rear trailing portion 244 of the facing.

The ability to easily separate the sled from the frame, and thereafter easily tip up the sled allows for easy cleaning of the various sled parts, for example the runners.

If any sort of a scrape or mark or dent gets on the trowel facing, or if it collects hardened coating material, it will leave an impression in the coating material behind it. So it's an advantage to be able to quickly replace the trowel cover with a new or clean one. The ability of the rear strike off auger and its scroll to ride up over bumps, such as a stud in the floor, is an advantage in protecting the auger's helix and also the bottom edge 156 of the scroll. If either of these become seriously nicked they will have a tendency to leave visible marks in the finished coating, which is undesirable. Thus the ride up or release feature with a final setting for the coating thickness by the wing bolt 155 is important. The initial thickness may be set before starting a job by putting shims under the strike off auger and setting its height with wing bolts 155, then setting shims under the bottom edge of the scroll and setting the wing bolts 156. In an initial start up there will by no material under the machine but the strike off auger and scroll will not contact the bare floor. This is also true of the trowel. Once the machine begins to work on material, gravity will hold the strike off auger and scroll down to their preset height unless they strike a protrusion in the floor, and the spring loading of the trowel will apply the proper amount of down load to compress the material to its final thickness. When the machine runs out of material, the strike off auger, scroll, and trowel will not hit the bare floor which could cause scratches or nicks in the parts.

While the preferred form and several variations of the invention have been shown and/or suggested, it should be understood that suitable modifications, changes, substitutions, and variations may be made without departing from the invention's fundamental theme.

The embodiments of the invention in which an exclusive property or privilege is claimed are defined as follows:

1. In a machine for applying a thin coating, for example on the order cf a fraction of an inch, of a sticky filled resinous material to a surface to be coated, such as a concrete floor or the like, a mobile frame constructed for movement in a defined direction over the surface to be coated, a laterally disposed auger on the frame adjacent the surface with a right hand section on one side and a left hand section on the other, means for rotating the auger in a direction bottom side forward in the direction of movement of the machine on the surface and at a sufficient rotational speed so that excess coating material on the surface will tend to be propelled forwardly, and a shroud over the top and rear of the auger with at least the lower portion of its interior closely spaced relative to the exterior of the auger and arranged to prevent coating material from being sprayed either up or to the rear, the rotational speed of the auger being high enough and its pitch being fine enough that it prevents the formation of objectionable marks in the surface of coating material under it.

2. The structure of claim 1 further including means for adjusting the vertical position of the auger on the frame so that the thickness of the coating on the surface after the excess is removed by the auger may be varied.

3. The structure of claim 1 further characterized in that the lower edge of the shroud is generally the same distance from the surface being coated as the bottom of the auger.

4. The structure of claim 1 further characterized by and including means for simultaneously adjusting the distance of both the bottom of the auger and the lower edge of the shroud from the surface being coated to vary the thickness of the coating on the surface.

5. The structure of claim 1 further characterized by and including means for adjusting the shroud relative to the auger so that the shroud may be adjustably positioned circumferentially around the auger.

6. The structure of claim 1 further characterized in that at least the lower portion of the shroud is fitted as close to the auger as manufacturing tolerances permit.

7. The structure of claim 1 further characterized by and including means for mounting the auger and shroud on the frame so that they are held in position by gravity and may rise in response to variations in the surface to protect the auger and shroud from damage.

8. The structure of claim 1 further characterized by and including a scraper disposed to scrape the edge of the auger to keep material from building up thereon.

9. The structure of claim 8 further characterized in that the scraper is mounted on the shroud.

10. The structure of claim 1 further characterized in that the auger is mounted on the frame with a quick connect-disconnect attachment means on at least one end so that it may easily be removed for cleaning.

11. The structure of claim 1 further characterized by and including a second laterally disposed auger on the frame ahead of the first mentioned auger in the direction of movement of the machine on the surface and constructed and arranged to spread coating material that is initially deposited in front of the machine and to rotate slower than the first mentioned auger so that it fails to throw coating material that is in contact with it.

12. In a machine for applying a coating to a surface to be covered, an elongated frame structure, at least one material working member on the frame structure for working the coating material on the surface to be coated, and quick connect-disconnect means between each of the material working members and the frame structure for removal and/or cleaning of each of the working members.

13. The structure of claim 12 further characterized in that the frame structure includes a frame, a tractor at one end thereof, and a coating sled generally under the other end, and quick connect-disconnect means between the frame and sled so that they may be easily separated, the material working member being on the sled.

14. The structure of claim 12 further characterized in that at least one of the material working members is a spreader member in the form of an auger.

15. The structure of claim 13 further characterized in that one of the material working members is a strike off member in the form of a shrouded auger, and further including a quick connect-disconnect means between the sled and the shrouded auger so that it may be easily removed for cleaning and/or replacement.

16. The structure of claim 13 further characterized in that the frame is connected to the front and rear of the sled and further including quick connect-disconnect means between both the front and rear of the sled and the frame so that the frame and sled may be quickly separated.

17. The structure of claim 16 further characterized by and including means connected between the frame and sled for raising the sled relative to the frame for transport.

18. The structure of claim 13 further characterized in that one of the material working members includes a trowel on the sled for troweling the coating after it is applied to the surface, means on the frame connected to the trowel for operating it, and a quick connect-disconnect means between the operating means and the trowel.

19. In a machine for applying a thin coating of a sticky filled resinous material to a surface, such as a floor, a mobile frame adapted to be moved in a defined direction along a surface to be coated, means on the frame for spreading and striking off a coating material as the machine is moved, a laterally disposed trowel on the frame behind the spreading and striking off means in relation to the direction of movement of the machine arranged to apply a troweling down force to the coating material on the surface, a separate facing on the trowel curved so as to present a convex surface to the coating material, means for mounting the trowel and facing so that the front edge of the facing will be appreciably higher than the rear edge, and quick release means between the facing and trowel so that the facing may be easily removed for cleaning.

20. The structure of claim 19 further characterized in that the facing is connected to the trowel at its front edge and extends freely beyond the rear edge of the trowel.

21. The structure of claim 19 further characterized in that the facing is more flexible and laterally longer than the trowel so that it extends freely beyond the trowel on each side, and an adjustable mounting for the facing for lateral adjustment on the trowel to be positioned in a number of lateral positions thereon so that it may be made coextensive with the trowel on one side and will extend beyond the trowel on the other side.

22. For use in a machine for applying a sticky filled resinous material to a surface to be coated, such as a concrete floor, the machine having a frame and means for propelling it in a defined direction, the improvement comprising a trowel adapted to be disposed on the frame generally lateral to its direction of movement, the trowel having a convex lower surface with its leading edge substantially higher than its trailing edge at least the portion of the convex lower surface of the trowel that contacts the coating material during spreading being swung on an arc having a radius on the order of 16"–20", the rear portion of the trowel adjacent the trailing edge being generally flat and tangent to the convex surface and in a plane slightly above and generally parallel to the surface being coated.

23. The structure of claim 22 further characterized in that the trowel is made up of a trowel support frame and a removable facing thereon, the facing being connected to the trowel support at a point higher than where the facing contacts the coating material during spreading.

24. The structure of claim 22 further characterized in that the majority of the trowel's convex surface is swung on a constant radius.

25. The structure of claim 22 further characterized in that the majority of the trowel's convex surface is swung on a changing radius.

26. The structure of claim 25 in which the majority of the trowel's lower surface is formed on a spiral.

27. In a machine for applying a trowelable material such as a filled resin in a thin layer, for example a fraction of an inch, to a surface to be coated, for example a concrete floor, the machine being movable in a defined direction, a sled with one or more longitudinally disposed generally parallel surface engaging runners on each side for supporting the sled on the surface to be coated, and a laterally disposed trowel structure mounted on the sled of a length at least as great as the distance between the runners and positioned closely adjacent the surface to be coated, the trowel being mounted on the sled behind the rear point of engagement of the runners with the surface being coated, in the direction of movement of the machine, so that any lateral outward flow of the coating material caused by the trowel structure will move without interference with the runners.

28. The structure of claim 27 in which the trowel structure extends laterally somewhat beyond the runners of the sled on both sides thereof so that coating material will also be troweled somewhat outside of the sled's runners.

29. A method of applying a coating of a trowelable sticky filled resinous material of a predetermined thickness and width in a defined path to a surface to be covered, such as a concrete floor or the like, including the sequential steps of supplying a batch of the coating material at a location on the surface, thereafter screeding the material to spread it to a width somewhat less than the predetermined width and to a thickness somewhat greater than the predetermined thickness, thereafter moving some of the material from the inside of the path to each side thereof to bring the coating to the predetermined width, thereafter striking off the excess thickness of material and simultaneously moving it from each side inwardly, propelling the excess material from the striking off step forwardly into the material in the moving step, and thereafter troweling the full width of the applied coating under substantial yieldable down pressure to densify the coating and to assist in affixing it to the surface and to bring the coating to the predetermined thickness.

30. In a machine for applying a coating of a trowelable material to a surface to be coated, such as a concrete floor or the like, a mobile frame constructed for movement in a given direction over a surface to be coated, an elongated rigid continuous trowel on the frame disposed in a substantially lateral direction relative to the direction of movement and in a position close to the surface to be coated, yieldable means on the frame for applying a yieldable down force to the trowel so that it, in turn, will apply a yieldable down force to the coating being applied, and an adjustable stop between the frame and trowel for setting and limiting the maximum down position of the trowel on the frame under the urging of the yieldable means, the adjustable stop being constructed so that the maximum down position of the trowel in all adjusted positions is always above the bottom of the frame.

31. The structure of claim 30 further characterized in that the lower surface of the trowel is downwardly convex.

32. The structure of claim 30 further characterized by and including operable means on the frame for overcoming the yieldable force applying means so that the trowel can be lifted relative to the frame and held clear of the coating.

33. The structure of claim 30 further characterized in that the yieldable down force applying means is adjustable so that a selected amount of down force may be applied, and operable means for overcoming the yieldable force applying means so that, at times, the trowel may be lifted clear of the coating and, when the operable means is manipulated, the selected down force will be reapplied.

34. The structure of claim 19 further characterized in that the trowel and facing extend beyond the sides of the frame.

35. The structure of claim 19 further characterized in that the facing extends beyond the lateral ends of the trowel.

36. In a machine for applying a coating to a surface to be coated, such as a concrete floor or the like, a mobile frame constructed for movement over a surface to be coated, a laterally disposed auger on the frame adjacent the surface with a right-hand section on one side and a left-hand section on the other, means for rotating the auger in a direction bottom side to the front in the direction of movement and at a speed so that the coating material will be propelled forwardly and, at the same time, will tend to be brought inwardly from each side to the middle, and a deflector over generally the full width of the auger for directing the material forwardly over its full width so that it is used in the coating process.

37. The structure of claim 36 further characterized by and including a second auger ahead of the first mentioned auger in the direction of machine travel with similar right and left hand sections, and means for rotating the second auger at a speed and in a direction that will spread the coating material from the middle of the path toward both sides.

38. In a machine for applying a coating of a trowelable material to a surface to be coated, such as a concrete floor or the like, a movable framework, a vertically movable trowel on the framework for vertical movement for applying a down pressure on the material to bring it to a desired thickness on the surface, a stop on the framework for fixing the maximum down position of the trowel spaced slightly above the surface, a yieldable down force means on the framework applied to the trowel for allowing the trowel to rise in response to a predetermined up force created by the coating material being troweled, and means for adjusting the stop on the framework so the maximum down position of the trowel may be varied, the adjustment means being constructed so that the maximum down position of the trowel in all adjusted positions is always above the surface being coated.

39. The structure of claim 38 further characterized by and including force varying means on the frame for changing the yieldable down force on the trowel to a selected value, and a throw out mechanism on the frame for releasing the selected down force on the trowel and also for returning it to the selected value without adjustment of the force varying means.

40. The structure of claim 39 further characterized in that the trowel is laterally elongated, and further including means for pivoting the trowel about a lateral axis near its forward edge.

41. The structure of claim 40 wherein the pivoting means is adjustable for height.

42. In a machine for applying a coating to a surface to be coated, such as a concrete floor, a mobile frame constructed for movement in a defined direction over a surface to be coated, two laterally disposed generally parallel augers on the frame adjacent the surface, one forward of the other and each having a right-hand section on one side and a left-hand section on the other, and means for rotating each of the augers so that the front auger will move material on the surface from the inside out to spread it and the rear auger will move the material from the outside in to strike it off to the proper thickness, the rear auger being rotated at a substantially greater rate of speed than the front auger, the rear auger being rotated at a speed that will cause some of the coating material to be propelled forwardly, and a deflector over generally the full width of the auger for directing the material forwardly over its full width so that it is used in the coating process.

43. In a machine for coating a surface to be coated, an elongated frame, a tractor unit at the front of the frame for propelling the machine, a sled at the rear of the frame in contact with the surface for applying the coating, a connection between the sled and the frame so that the tractor and frame will move the sled, a laterally disposed trowel on the sled for applying a down force to the coating being applied to the surface, and a fulcrum between the frame and sled longitudinally proximate to the trowel whereby a portion of the weight of the frame is applied through the fulcrum to the sled and trowel and the frame is allowed to rock about a transverse axis at the fulcrum without rocking the sled.

44. In a machine for applying a coating of trowelable material to a surface to be coated, such as a floor or the like, a frame movable in a given direction on the surface, a trowel on the frame disposed in a generally lateral direction relative to the direction of movement of the frame, and a removable and replaceable facing on and conforming to the exterior of the trowel extending at least substantially the full lateral width of the trowel, means on the frame for applying a yieldable down force to the trowel so that it, in turn, will be transmitted by the facing to the coating being applied, the lower surfaces of the trowel and facing being downwardly convex with the forward edge of the facing curving reversely around the forward edge of the trowel so that the facing can be slid laterally on and off of the trowel.

* * * * *